United States Patent [19]

Sarrafian et al.

[11] 4,239,200

[45] Dec. 16, 1980

[54] FOOT-ANKLE SURGICAL TABLE

[76] Inventors: Shahan K. Sarrafian, 4343 Davis, Skokie, Ill. 60076; Vahram K. Sarrafian, 4100 Chester Dr., Glenview, Ill. 60025

[21] Appl. No.: 9,259

[22] Filed: Feb. 5, 1979

[51] Int. Cl.[3] ..... A61G 13/00

[52] U.S. Cl. ..... 269/328

[58] Field of Search ..... 269/322, 327, 328; 5/443, 444, 431

[56] References Cited

U.S. PATENT DOCUMENTS

| | | | |
|---|---|---|---|
| 542,390 | 7/1895 | Linn | 269/328 |
| 784,425 | 3/1905 | Phillips | 269/328 |
| 810,820 | 1/1906 | Suddarth | 269/328 |
| 828,007 | 8/1906 | Williams | 269/328 |
| 1,517,960 | 12/1924 | Cuccia | 269/328 |
| 2,910,259 | 10/1959 | Johnson | 269/328 |
| 3,327,328 | 6/1967 | Slivoski | 5/431 |
| 4,045,011 | 8/1977 | Ford | 269/328 |

*Primary Examiner*—Robert C. Watson

*Attorney, Agent, or Firm*—Vogel, Dithmar, Stotland, Stratman & Levy

[57] ABSTRACT

A generally Y-shaped, flat table is detachably coupled to a surgical table by a coupling tongue and has outwardly diverging branches for respectively receiving the ankles and feet of a patient thereon, the branches defining therebetween an access space for accommodating the surgeon. Each branch has a foldable, adjustable-length support leg assembly. In one embodiment, the branches are pivotally coupled to a body member for varying the angle of divergence therebetween and the size of the access space.

16 Claims, 6 Drawing Figures

FOOT-ANKLE SURGICAL TABLE

BACKGROUND OF THE INVENTION

This invention relates to surgical apparatus and, more particularly, to apparatus for supporting the legs and feet of a patient during surgery.

Surgical procedures involving the feet and ankles are usually conducted while the patient is lying in a supine position upon a surgical table. Typically the surgeon and the assistants are standing up at the foot end and adjacent sides of the table or are sitting in the same relative positions and have no elbow or forearm support. In this position, the surgical field is not perpendicular to the line of vision. Typically, the surgeon and the assistant do not face each other and the patient's foot and ankle are not located between them.

Furthermore, in the case of foot surgery, modern surgical procedures often require exact dissection and fine reconstruction. For example, microsurgery of the foot—such as reimplantation of an amputated foot or the use of a part of the foot as a donor to the hand, as in the transfer of a big toe as a thumb to the hand—requires prolonged hours of minute dissection. The standard operating table does not permit the surgeon and/or his assistants comfortably to rest their arms during the long hours of delicate operation.

Accessory devices have been provided for attachment to medical tables and the like for supporting a patient's hand or arm. Such devices are disclosed, for example, in U.S. Pat. No. 2,609,261, issued to J. A. Parker on Sept. 2, 1952, and U.S. Pat. No. 4,045,011, issued to J. L. Ford on Aug. 30, 1977. U.S. Pat. No. 3,046,072, issued to Douglass, Jr. et al. on July 24, 1962 also discloses an accessory board for supporting a patient's arm or leg in a laterally outstretched position. But these prior devices are not suitable for supporting a patient's feet, particularly both feet simultaneously. No prior art devices have been provided for attachment to a surgical table to support a patient's legs and feet during the performance of surgical procedures thereon.

SUMMARY OF THE INVENTION

Accordingly, it is a general object of the present invention to provide a table for mounting on a surgical table to support a patient's legs and feet.

More particularly, it is an object of this invention to provide a table which simultaneously supports both of the patient's legs and feet in a spaced-apart position so that the surgeon can move therebetween and have equal access to either foot or ankle.

Still another object of this invention is to provide a table of the type set forth which affords an area for a surgeon to rest his elbows and forearms.

Another object of this invention is to provide a table of the type set forth, which includes support means adaptable for supporting the table in a level position in association with surgical tables of varying heights.

It is another object of this invention to provide a table of the type set forth which permits variation of the size of the access space between the patient's feet and ankles.

Briefly, to achieve the desired objects of the present invention in accordance with a preferred embodiment thereof, there is provided a table for detachable coupling to a surgical table and for supporting the legs and feet of a patient during surgical procedures, the table comprising a body member, two branches on the body member diverging outwardly therefrom and defining therebetween an access space for accommodating a surgeon, each of the branches having an upper surface for receiving a corresponding one of a patient's legs and feet thereon, and coupling means extending from the body member in a direction away from the branches for detachably coupling the body member to the associated surgical table.

The invention consists of certain novel features and the combination of parts hereinafter fully described, illustrated in the accompanying drawings, and particularly pointed out in the appended claims, in being understood that various changes in the details may be made without departing from the spirit, or sacrificing any of the advantages, of the invention.

BRIEF DESCRIPTION OF THE DRAWINGS

For the purposes of facilitating an understanding of the invention, there is illustrated in the accompanying drawings, two preferred embodiments thereof, from an inspection of which, when considered in connection with the following description, the invention, its construction and operation, and many of its advantages should be readily understood and appreciated.

DESCRIPTION OF THE PREFERRED EMBODIMENTS

Figure 1:
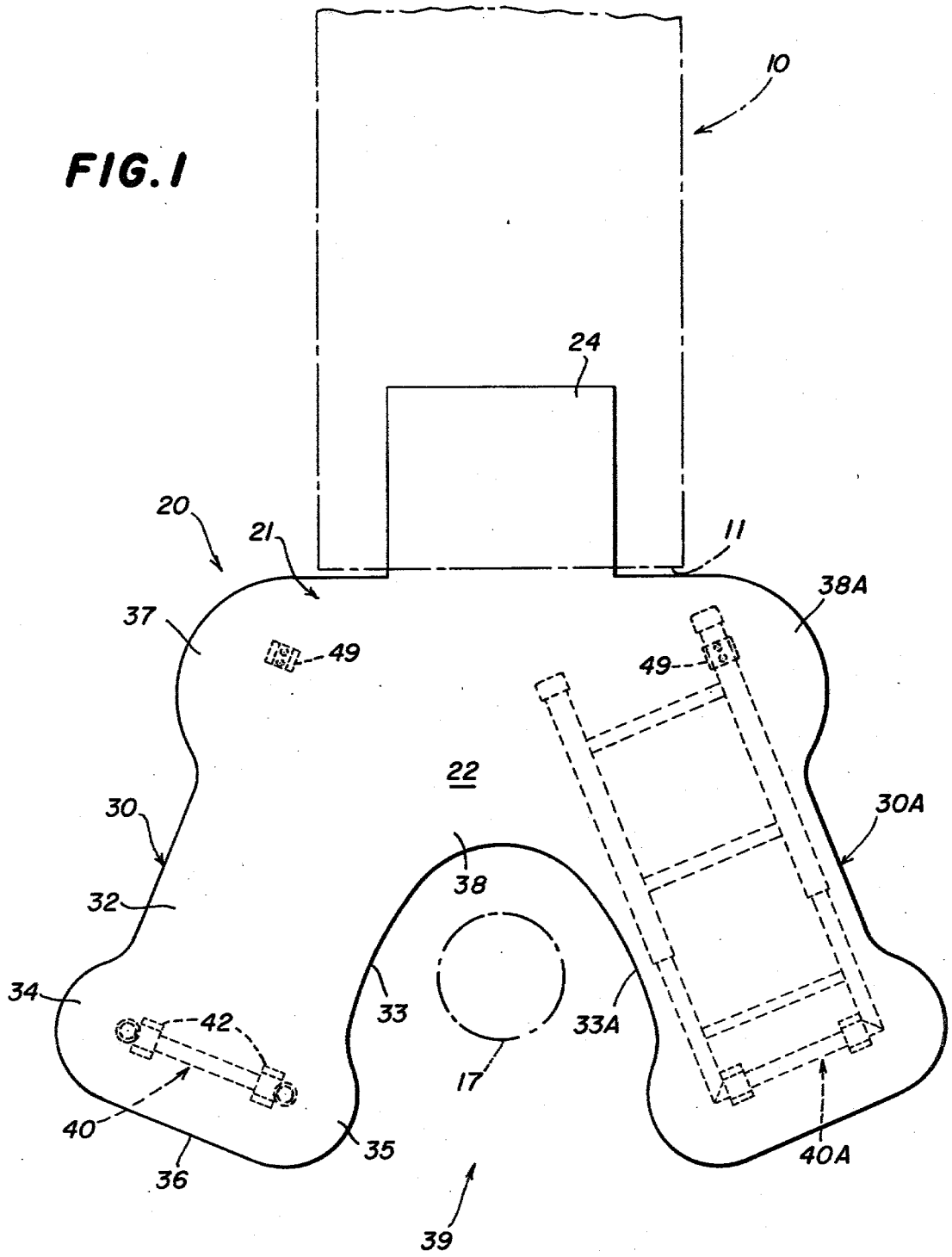
FIG. 1 is a top plan view of a table constructed in accordance with and embodying the features of a first embodiment of the present invention.
Figure 2:
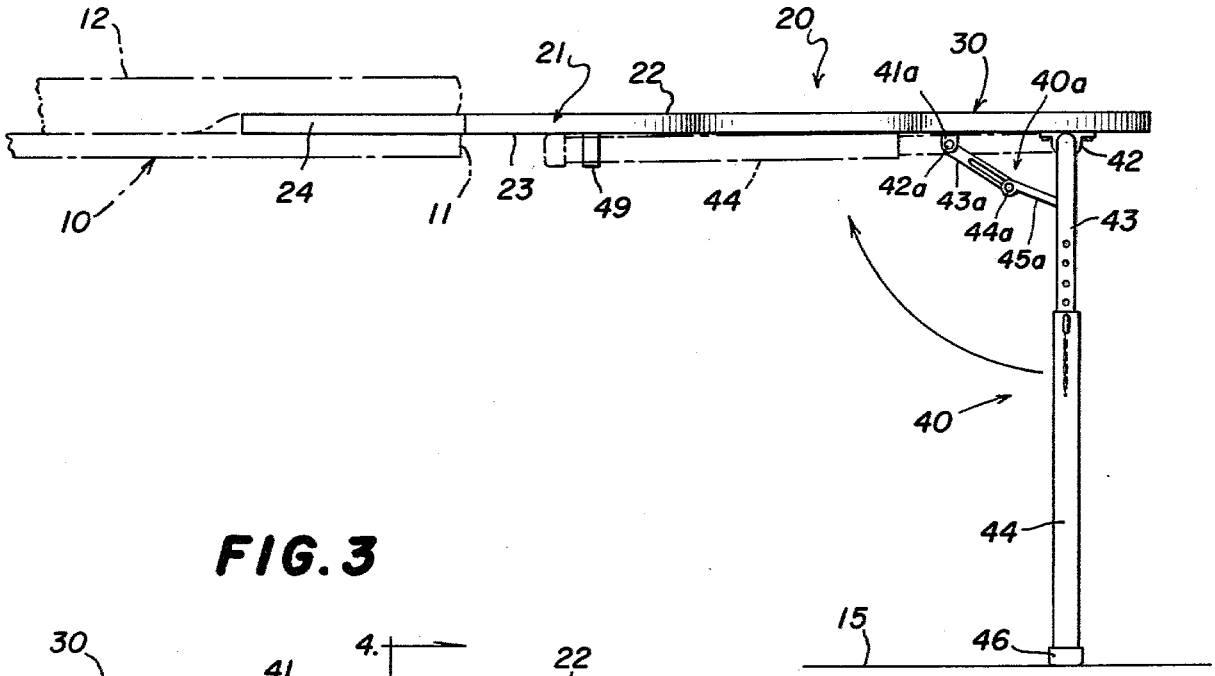
FIG. 2 is a side elevational view of the table of FIG. 1, as viewed from the left-hand side thereof, with the support leg assembly shown in the extended supporting position thereof.

Referring now to FIGS. 1 and 2 of the drawings, there is illustrated a portion of an operating table, generally designated by the numeral 10, having a foot end designated by the numeral 11. The upper surface of the operating table 10 is covered with a rectangular pad 12 in a well-known manner. Typically, the operating table 10 will be mounted on the floor 15 of an operating room or the like, there also being provided a stool or chair 17 which can preferably be rolled along the floor 15 and on which the surgeon may sit during extended procedures.

The present invention resides in a table, generally designated by the numeral 20, for coupling to the foot end 11 of the operating table 10 to support the legs and feet of a patient. The table 20 is preferably in the form of a substantially flat board having a generally Y-shaped configuration and being of integral, one-piece construction. More particularly, the table 20 includes a body member, generally designated by the numeral 21, having parallel flat planar upper and lower surfaces 22 and 23. Integral with the body member 21 and projecting from one end thereof is a generally rectangular coupling tongue 24, which may have an upper surface substantially coplanar with the upper surface 22, and which is adapted for insertion beneath the pad 12 and the upper surface of the operating table 10 from the foot end 11 thereof.

Also integral with the body member 21 and extending therefrom generally in the direction opposite to the coupling tongue 24 are two branch portions 30 and 30A, which are constructed substantially as mirror images of each other. Accordingly, only the branch portion 30 will be described in detail, and the several parts of the branch portion 30A will bear the same reference numerals as the corresponding parts of branch portion 30, with the addition of the letter A suffix. The branch portion 30 includes an elongated shank 32 having an irregular concave inner edge 33, and is provided adjacent to the distal end thereof with two lateral projections 34 and 35 respectively extending outwardly from the opposite sides of the shank 32. The shank 32 terminates in a straight distal end edge 36 which is disposed substantially normal to the longitudinal axis of the shank 32. The shank 32 is also provided adjacent to the opposite end thereof with a lateral projection 37 extending outwardly from the outer edge thereof, and an enlarged inner lateral region 38. The concave inner edges 33 and 33A of the branch portions 30 and 30A join at the inner ends thereof to form a continuous concave curvilinear edge which defines a large irregular recess or access space 39 between the branch portions 30 and 30A. The access space 39 is dimensioned and shaped to accommodate the surgeon so that he can sit upon the stool 17 between the branch portions 30 and 30A and turn to face either of the patient's feet.

Figure 3:
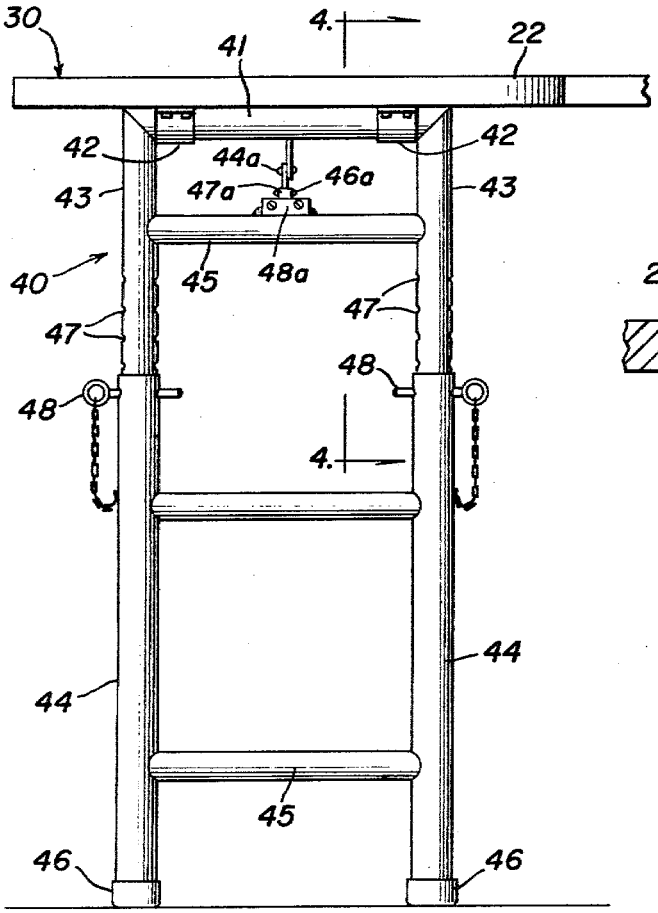
FIG. 3 is an enlarged end elevational view of the table of FIG. 2, as viewed from the right-hand end thereof.
Figure 4:
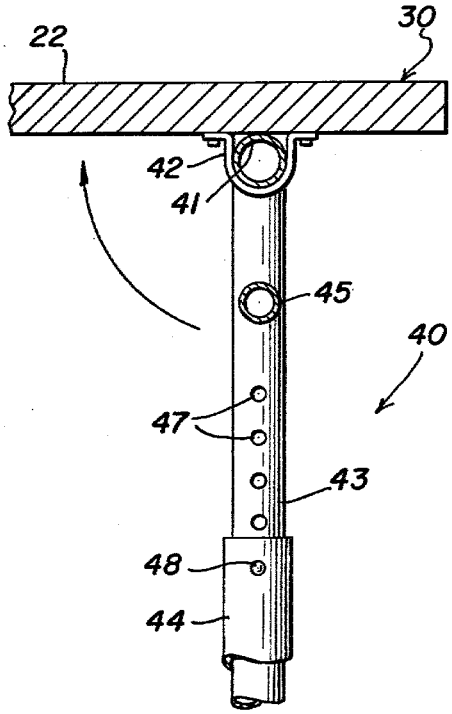
FIG. 4 is a further enlarged fragmentary view in vertical section taken along the line 4—4 in FIG. 3.

The branch portions 30 and 30A are respectively provided with identically-constructed leg assemblies 40 and 40A. The parts of the leg assembly 40A are designated by the same reference numerals as the corresponding parts of the leg assembly 40, with the letter A suffix added. Thus, only the leg assembly 40 will be described in detail. Referring now also to FIGS. 3 and 4 of the drawings, the leg assembly 40 includes a tubular mounting bar 41 disposed along the underside of the branch portion 30 adjacent to the distal end thereof and coupled thereto by two bearing brackets 42 which permit rotational movement of the mounting bar 41 about its longitudinal axis. Respectively connected to the opposite ends of the mounting bar 41 and extending therefrom substantially normal thereto are a pair of parallel tubular inner leg members 43, the lower ends of which are respectively telescopically received within the upper ends of a pair of tubular outer leg members 44. Interconnecting the inner leg members 43 is a crossbar 45, two additional crossbars 45 also interconnecting the outer leg members 44. Each of the outer leg members 44 is closed at the lower end thereof with a footpad 46.

Each of the inner and outer leg members 43 and 44 is provided with a plurality of longitudinally spaced-apart apertures 47 extending diametrically laterally therethrough, the apertures 47 in the inner leg members 43 being respectively disposable in alignment with the apertures 47 in the outer leg members 44 for receiving therethrough pins 48. Thus, the length of the leg assembly 40 may be varied by relative sliding movements of the inner and outer leg members 43 and 44 and may be locked at any selected length by means of the pins 48. Also secured to the underside of the branch portion 30 adjacent to the inner end thereof is a retaining bracket 49 having a pair of depending arms for resiliently clamping one of the outer leg members 44 therebetween to hold the leg assembly 40 against the underside of the branch portion 30 in a folded storage position, illustrated in broken line in FIG. 2.

Thus, it will be appreciated that the leg assembly 40 can be pivotally moved between the extended supporting position, illustrated in solid line in the drawings for supporting engagement with the underlying floor 15, and the broken-line storage position when not in use. In their extended supporting position, the leg assemblies 40 and 40A cooperate with the coupling tongue 24 to support the table 20 in a substantially horizontal position, the adjustability of the leg assemblies 40 and 40A permitting use of the table 20 with operating tables 10 of varying heights.

Preferably, each of the leg assemblies 40 and 40A is also provided with a brace assembly, generally designated by the numeral **40*a*, which includes a pivot bracket 41*a* fixedly secured by a suitable fastener to the underside of the associated branch portion 30A, and provided with a pivot pin 42*a* to which is pivotally connected one end of an elongated brace arm 43*a*. The other end of the brace arm 43*a* is hingedly connected by a pin 44*a* to one end of an elongated brace arm 45*a*, the other end of which is pivotally connected by a pin 46*a* to a pivot bracket 47*a*. The pivot bracket 47*a* is fixedly secured by a suitable fastener to a mounting plate 48*a* which is secured, as by welding, to one of the crossbars 45 of the associated leg assembly. When the leg assembly 40 is disposed in its extended supporting position, the brace assembly 40*a* is locked in the bracing position illustrated in FIG. 2, wherein the brace arms 43*a* and 45*a* are disposed in alignment for bracing the leg assembly 40. For folding the leg assembly 40 to its storage position, a slight inward force is exerted on the brace assembly 40*a* at the pin 44*a*, whereupon the brace arms 43*a* and 45*a* fold inwardly in the direction of the arrow indicated in FIG. 2**.

In use, the patient's feet are respectively supported on the branch portions 30 and 30A, while the surgeon preferably sits on the stool 17 in the access space 39, where he has ready access to both of the patient's feet. It will also be appreciated that the lateral projection 35 and the enlarged inner lateral region 38 adjacent to the access space 39 provide areas on which the surgeon may rest his elbows and forearms during prolonged and tedious procedures. Similarly, the lateral projections 34 and 47 along the outboard side of the branch portion 30 provide arm rest areas on the outside of the branch portion 30. Thus, the surgeon may position himself along the outside of the patient's foot or, alternatively, an assistant may be positioned at that location opposite the surgeon for close access to the foot being operated upon. It will be understood that the same elbow and forearm rest features are provided by the branch portion 30A.

In a constructional model of the table 20, the overall length from the tip of the coupling tongue 24 to the distal end of the branch portions 30 and 30A is approximately 48 inches, the maximum width between the outermost points of the branch portions 30 and 30A is approximately 56 inches, the width of the coupling tongue 24 is approximately 14 inches, the maximum width of the access space 39 is approximately 19 inches and the neck of the access space 39 between the lateral projections 35 and 35A is about 18 inches. The angle between the longitudinal axes of the branch portions 30 and 30A is approximately 45 degrees.

Figure 5:
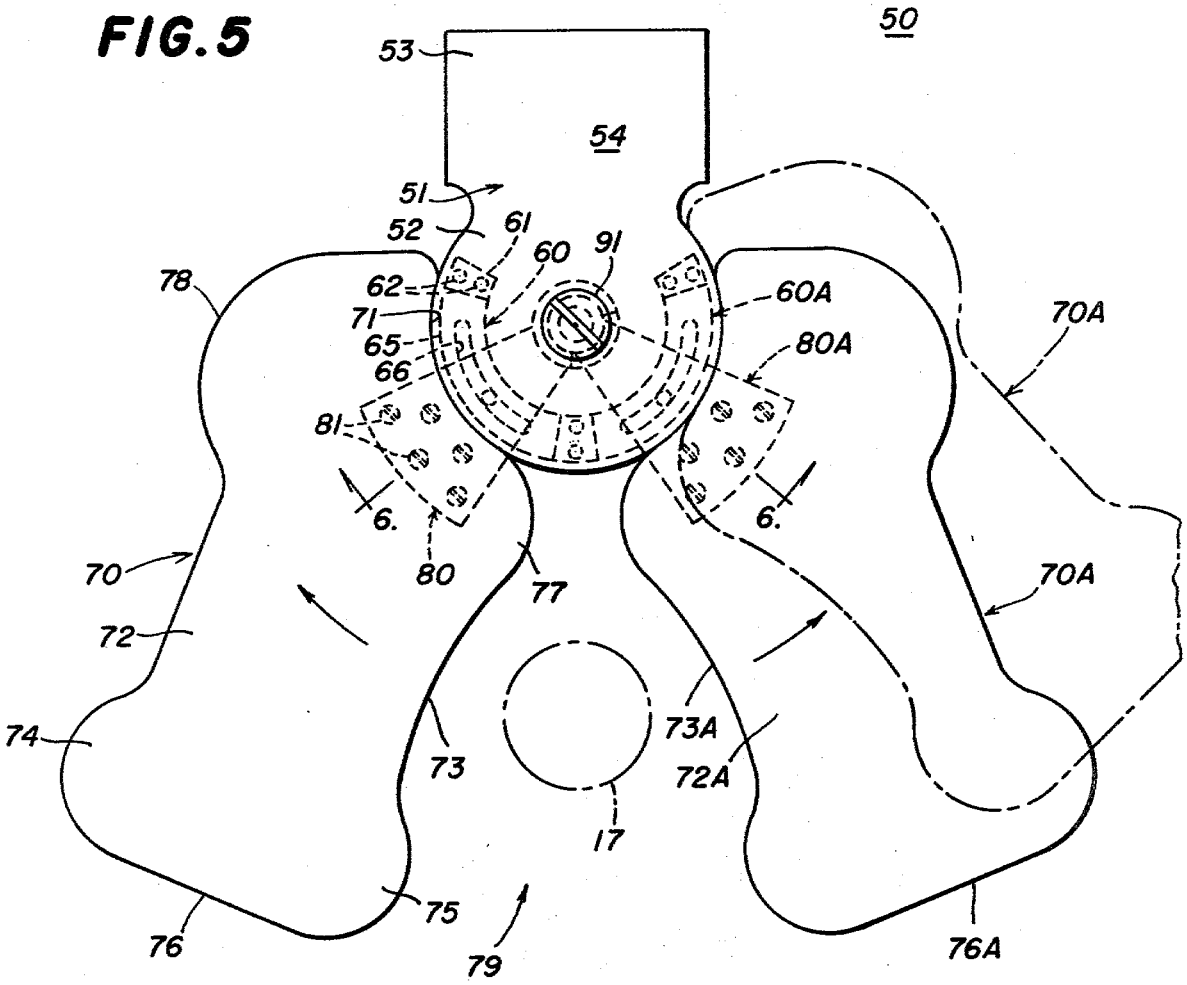
FIG. 5 is a top plan view of a table constructed in accordance with and embodying the features of a second embodiment of the present invention.
Figure 6:
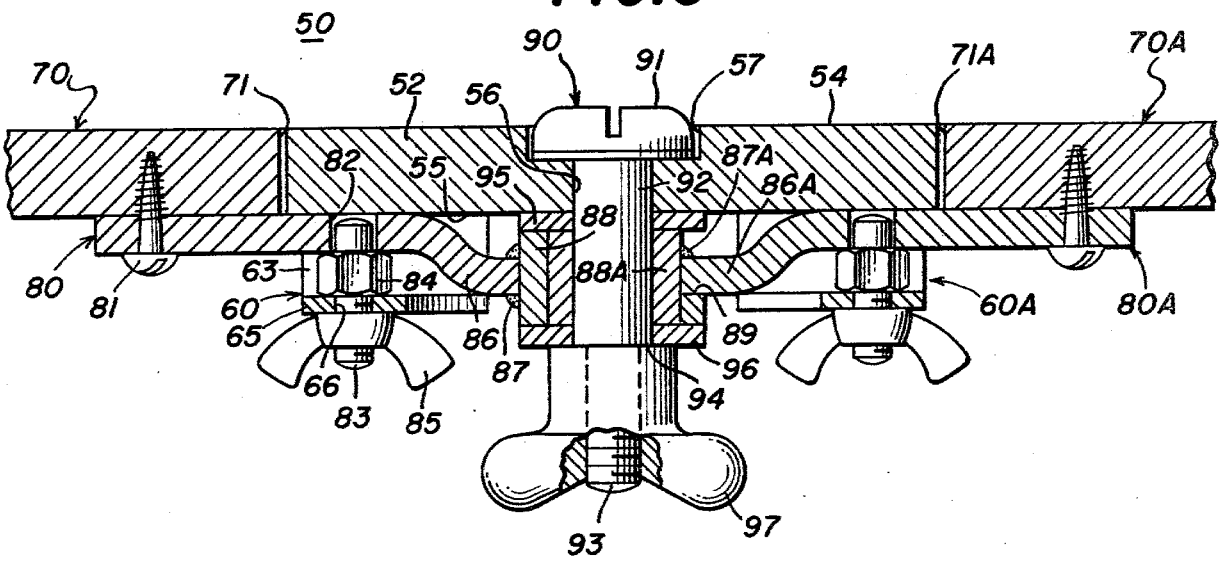
FIG. 6 is an enlarged fragmentary view in vertical section taken along the line 6—6 in FIG. 5.

Referring now also to FIGS. 5 and 6 of the drawings, there is illustrated a second embodiment of the table of the present invention, generally designated by the numeral 50, which includes a body member 51 which is substantially in the form of a flat planar board and has a part-circular hub portion 52 and a generally rectangular coupling tongue 53 projecting from the hub portion 52. The body member 51 has substantially parallel upper and lower surfaces 54 and 55. Extending through the hub portion 52 centrally thereof between the upper and lower surfaces 54 and 55 is a circular aperture 56 having a circular countersink 57 around the upper end thereof.

Fixedly secured to the underside of the hub portion 52 along opposite sides thereof are two identically-constructed but oppositely-assembled slide brackets, respectively generally designated by the numerals 60 and 60A. Only the slide bracket 60 will be described in detail, it being understood that individual parts of the slide bracket 60A have reference numerals the same as the corresponding parts of the slide bracket 60, but with the letter A suffix added. The slide bracket 60 is arcuate in shape and includes a pair of attachment flanges 61 at the opposite ends thereof adapted to be secured to the underside of the hub portion 52 by screws 62. Respectively integral with the attachment flanges 61 and extending downwardly therefrom substantially normal thereto are flanges 63 and 64, the lower ends of which are interconncted by an integral arcuate bottom plate 65 having an elongated arcuate slot 66 formed therethrough and extending a substantial portion of the length thereof.

The table 50 also includes two branch members 70 and 70A which are constructed substantially as mirror images of each other. Thus, only the branch member 70 will be described in detail, it being understood that the individual parts of the branch member 70A have reference numerals the same as the corresponding parts of the branch member 70, but with the letter A suffix added. The branch member 70 is generally in the form of an elongated flat board with a shank 72 having a concave end edge 71 with a radius of curvature only slightly greater than the radius of curvature of the hub portion 52 of the body member 51 for mating therewith. The shank 72 also has an irregular concave inner side edge 73 and terminates in a straight distal end edge 76 which is disposed substantially normal to the longitudinal axis of the shank 72. Projecting laterally outwardly from the shank 72 adjacent to the distal end thereof at the opposite sides thereof are two rounded lateral projections 74 and 75. In like manner, the shank 72 is provided adjacent to the inner end thereof with rounded lateral projections 77 and 78. The branch members 70 and 70A are adapted to be mounted on the hub portion 52 of the body member 51, in a manner which will be explained more fully below, in order to define therebetween an irregular recess or access space 79 for accommodating the surgeon.

Respectively fixedly secured to the undersides of the branch members 70 and 70A are elongated mounting plates 80 and 80A which are substantially identical in construction, wherefore only the mounting plate 80 will be described in detail, it being understood that the individual parts of the mounting plate 80A bear reference numerals the same as the corresponding parts of the mounting plate 80, but with the letter A suffix added. The mounting plate 80 is generally in the shape of a truncated sector, and is fixedly secured adjacent to one end thereof to the underside of the inner end of the branch member 70 by a plurality of mounting screws 81, with the opposite end of the mounting plate 80 projecting outwardly well beyond the inner end of the branch member 70 radially of the concave end edge 71.

In use, the branch member 70 is disposed with the concave end edge 71 thereof in closely mating relationship with the outer arcuate edge of the hub portion 52 of the body member 51, with the mounting plate 80 extending beneath the hub portion 52 and between the lower surface thereof and the bottom plate 65 of the slide bracket 60. The mounting plate 80 is provided intermediate its ends, and outboard of the branch member 70 with an aperture 82 therethrough for receiving in the lower end thereof the upper end of an externally threaded stud 83, the lower end of which extends downwardly through the elongated slot 66 in the slide bracket 60. Preferably, a spacer nut 84 is threadedly engaged with the stud 83 and disposed in use between the mounting plate and the bottom plate 65 of the slide bracket 60 for maintaining a predetermined separation therebetween, the stud 83 being retained with respect to the slide bracket 60 by a wing nut 85. The mounting plate 80 is provided with a downwardly offset inner end 86 which is connected, as by weldment 87, to the outer surface of a cylindrical collar or sleeve 88.

The construction of the mounting plate 80A is substantially the same, with the exception that the inner end 86A thereof is secured to a cylindrical collar or sleeve 88A which is of a smaller diameter than the collar or sleeve 88 and is adapted to fit coaxially therewithin. For this purpose, an arcuate slot 89 is provided in the collar 88 to permit the inner end 86A of the mounting plate 80A to pass therethrough so that it can be secured to the outer surface of the collar or sleeve 88A as by weldment 87A.

In use, the collars or sleeves 88 and 88A are disposed coaxially with the aperture 56 in the hub portion 52 for receiving therethrough a bolt 90, which has an enlarged head 91 receivable in the countersink 57 of the aperture 56. The bolt 90 has an enlarged shank 92 with a diameter slightly less than the inner diameter of the collar or sleeve 88A, the distal end of the bolt 90 forming a reduced diameter externally threaded stud portion 93, with the transition between the stud portion 93 and the enlarged shank 92 defining an annular shoulder 94. Preferably, annular washers 95 and 96 are disposed above and below the collars 88 and 88A around the enlarged shank 92, so that, when the parts are held together, the bottom surface of the lower washer 96 is disposed slightly above the annular shoulder 94 to provide sufficient clearance for the collars 88 and 88A to rotate. The parts are retained in assembled condition by a locknut 97 which is stopped by the annular shoulder 94 so as not to compress the assembled parts together. Thus, it is insured that there will be sufficient play to permit free rotation of the collars 88 and 88A with respect to each other and with respect to the bolt 90.

It will be appreciated that when the wing nuts 85 and 85A are loosened, the branch members 70 and 70A may be pivoted with respect to the axis of the bolt 90 for varying the positions thereof with respect to the body member 51. Thus, for example, the branch member 70A may be moved between the solid-line and broken-line positions illustrated in FIG. 5. When the branch members 70 and 70A have been moved to the desired location, they are secured in position by tightening the wing nuts 85 and 85A. It will be understood that as the positions of the branch members 70 and 70A are varied, the size of the access space 79 is correspondingly varied. Thus, by this simple adjustment feature, the angle of divergence of the branch members 70 and 70A can be changed and the size and shape of the access space 79 can be changed for accommodating different size patients and different size surgeons. It will be noted that, preferably, the branch members 70 and 70A have flat planar upper surfaces which are disposed, in use, substantially coplanar with the upper surface 54 of the body member 51.

The table 50 is mounted on the operating table 10 by inserting the coupling tongue 53 beneath the pad 12 in the same manner as was described above with respect to the table 20. It will also be understood that each of the branch members 70 and 70A may be provided with a leg assembly like the leg assembly 40 described above, for assisting in supporting the table 50 in a horizontal position.

In a constructional model of the table 50, the coupling tongue 53 has a width of approximately 14 inches, the overall length of the table 50 is approximately 48 inches, the overall length of each of the branch members 70 and 70A is approximately 32 inches, the radius of the hub portion 52 is approximately $7\frac{3}{4}$ inches, and the minimum width of the shanks 72 and 72A of the branch members 70 and 70A is approximately $14\frac{3}{8}$ inches. Each of the branch members 70 and 70A is capable of adjustment over a range of approximately 50 degrees of arc.

While a coaxial collar assembly has been described for pivoting the branch members 70 and 70A, it will be understood that alternatively the inner ends of the mounting plates 80 and 80A could be extended and have different amounts of offset and be provided with coaxial openings for receiving the bolt 90 directly therethrough, thereby doing away with the collars 88 and 88A.

From the foregoing, it can be seen that there has been provided a novel table for use with a surgical table to support a patient's legs and feet and permit access of a surgeon therebetween.

What is claimed is:

1. A table for detachable coupling to a surgical table and for supporting simultaneously both of the legs and feet of a patient during surgical procedures, said table comprising a body member, two branches on one end of said body member diverging outwardly therefrom and defining therebetween an access space for accommodating a surgeon, each of said branches having an upper surface dimensioned for receiving a corresponding one of a patient's fully-extended legs and feet thereon, and coupling means extending from the other end of said body member opposite said branches for detachably coupling said body member to the associated surgical table, each of said branches having a length as measured from the outer end thereof to the inner end of said access space which is substantially greater than the length of said body member is measured from the inner end of said access space to the inner end of said coupling means.

2. The table of claim 1, wherein said body member and said branches and said coupling means are integrally formed of a single piece of material.

3. The table of claim 1, wherein said body member and said branches all have upper surfaces lying in a common plane.

4. The table of claim 1, wherein said coupling means comprises a tongue integral with said body member and projecting therefrom.

5. The table of claim 1, wherein the perimeter of said access space defined by said branches is curvilinear.

6. A table for detachable coupling to a surgical table and for supporting simultaneously both of the legs and feet of a patient during surgical procedures, said table comprising a body member, two branches on one end of said body member diverging outwardly therefrom and defining therebetween an access space for accommodating a surgeon, each of said branches having an upper surface dimensioned for receiving a corresponding one of a patient's fully-extended legs and feet thereon, coupling means extending from the other end of said body member opposite said branches for detachably coupling said body member to the associated surgical table, and support means associated with said body member and said branches and extendable therefrom for supporting engagement with an underlying floor, each of said branches having a length as measured from the outer end thereof to the inner end of said access space which is substantially greater than the length of said body member as measured from the inner end of said access space to the inner end of said coupling means.

7. The table of claim 6, wherein said support means comprises two suppoert legs respectively carried by said branches.

8. The table of claim 6, wherein said support means includes a foldable leg mounted on one of said branches for pivotal movement between an extended position disposed for supporting engagement with the underlying floor and a folded position lying against the underside of said branch for storage.

9. The table of claim 6, wherein said support means includes a leg assembly connected to one of said branches, said leg assembly including first and second leg portions movable with respect to each other for varying the length of said assembly thereby to adjust the height of said table in use.

10. The table of claim 6, wherein said support means includes a leg assembly connected to one of said branches, said leg assembly including a first leg member pivotally connected to said branch for movement between an extended position and a folded position, and a second leg member coupled to said first leg member and movable with respect thereto for varying the length of said leg assembly, said second leg member being disposable in supporting engagement with the underlying floor when said first leg member is disposed in its extended position, said leg assembly being disposed against the underside of said branch when said first leg member is disposed in its folded position.

11. A table for detachable coupling to a surgical table and for supporting simultaneously both of the legs and feet of a patient during surgical procedures, said table comprising a body member, coupling means on one end of said body member for detachable coupling thereof to the associated surgical table, and two branch members mounted on the other end of said body member for pivotal movement with respect thereto and diverging outwardly therefrom, said branch members being movable for varying the angle of divergence therebetween and for defining therebetween a variable-size access space to accommodate a surgeon, each of said branch members having an upper surface dimensioned for receiving a corresponding one of a patient's fully-extended legs and feet thereon, each of said branch members having a length as measured from the outer end thereof to the inner end of said access space which is substantially greater than the length of said body member is measured from the inner end of said access space to the inner end of said coupling means.

12. A table for detachable coupling to a surgical table and for supporting simultaneously both of the legs and feet of a patient during surgical procedures, said table comprising a body member, two branches on one end of said body member diverging outwardly therefrom and defining therebetween an access space for accommodating a surgeon, each of said branches having an upper surface dimensioned for receiving a corresponding one of a patient's fully-extended legs and feet thereon and including at least one laterally projecting portion forming a surgeon's elbow and forearm rest, and coupling means extending from the other end of said body member opposite said branches for detachably coupling said body member to the associated surgical table.

13. A table for detachable coupling to a surgical table and for supporting simultaneously both of the legs and feet of a patient during surgical procedures, said table comprising a body member, coupling means on one end of said body member for detachable coupling thereof to the associated surgical table, and two branch members mounted on the other end of said body member for pivotal movement with respect thereto about a common pivot axis and diverging outwardly therefrom, said branch members being movable for varying the angle of divergence therebetween and for defining therebetween a variable-size access space to accommodate a surgeon, each of said branch members having an upper surface dimensioned for receiving a corresponding one of a patient's fully-extended legs and feet thereon.

14. A table for detachable coupling to a surgical table and for supporting simultaneously both of the legs and feet of a patient during surgical procedures, said table comprising a body member having an upper surface, coupling means on one end of said body member for detachable coupling thereof to the associated surgical table, and two branch members mounted on the other end of said body member for pivotal movement with respect thereto and diverging outwardly therefrom, said branch members being movable for varying the angle of divergence therebetween and for defining therebetween a variable-size access space to accommodate a surgeon, each of said branch members having an upper surface dimensioned for receiving a corresponding one of a patient's fully-extended legs and feet thereon, said upper surfaces of said branch members being substantially coplanar with each other and with said upper surface of said body member.

15. A table for detachable coupling to a surgical table and for supporting simultaneously both of the legs and feet of a patient during surgical procedures, said table comprising a body member, coupling means on one end of said body member for detachable coupling thereof to the associated surgical table, a pivot shaft carried by said body member and extending therebelow, two branch members mounted on the other end of said body member and diverging outwardly therefrom, and two coupling assemblies respectively carried by said branch members for coupling thereof to said pivot shaft for pivotal movement with respect thereto, said branch members being movable for varying the angle of divergence therebetween and for defining therebetween the variable-size access space to accommodate a surgeon, each of said branch members having an upper surface dimensioned for receiving a corresponding one of a patient's fully-extended legs and feet thereon.

16. The table of claim 15, and further including means for securely holding each of said branch members in a selected position with respect to said body member.

* * * * *